US005106277A

United States Patent [19]

Tuckey

[11] Patent Number: 5,106,277

[45] Date of Patent: Apr. 21, 1992

[54] DRIVE CONNECTION FOR FUEL PUMP ROTOR

[75] Inventor: Charles H. Tuckey, Cass City, Mich.

[73] Assignee: Walbro Corporation, Cass City, Mich.

[21] Appl. No.: 569,711

[22] Filed: Aug. 21, 1990

[51] Int. Cl.[5] ..... F04B 21/00

[52] U.S. Cl. ..... 417/423.1; 403/354; 403/379; 464/51; 416/204 R

[58] Field of Search ..... 417/360, 423.1, 423.6, 417/423.14, 423.15, 319; 416/204 R, 206; 403/354, 355, 378, 379; 418/69, 182; 464/51, 101, 182

[56] References Cited

U.S. PATENT DOCUMENTS

| | | | |
|---|---|---|---|
| 2,811,867 | 11/1957 | Hogberg | 464/182 X |
| 2,954,991 | 10/1960 | Seider | 403/354 |
| 2,972,493 | 2/1961 | Waters | 403/354 |
| 3,169,032 | 2/1965 | Pastor | 403/354 |
| 3,342,273 | 9/1967 | Crane | 416/204 |
| 3,947,149 | 3/1976 | MacManus | 415/55.4 |
| 4,246,976 | 1/1981 | McDonald, Jr. | 415/903 X |
| 4,557,672 | 12/1985 | Levine | 417/360 |
| 4,715,777 | 12/1987 | Tuckey | 415/55.1 |
| 4,784,587 | 11/1988 | Takei et al. | 417/423.6 |
| 4,958,984 | 9/1990 | Aoi et al. | 403/355 X |
| 4,958,997 | 9/1990 | Harwath | 403/354 X |
| 4,978,282 | 12/1990 | Fu et al. | 417/360 |

*Primary Examiner*—Leonard E. Smith

*Attorney, Agent, or Firm*—Barnes, Kisselle, Raisch, Choate, Whittemore & Hulbert

[57] ABSTRACT

A fuel pump for an internal combustion engine has a rotor which is driven by the extended, rotating, mounting shaft of an electric motor armature. The shaft, with a round cross-section, extends through a round hole in the rotor with a firm fit but the shaft is slotted axially to receive the bight of a U-shaped wire which has slightly diverging legs. The rotor has axially directed, tapered, drive holes spaced from the axis on each side of the hole in the rotor. The legs project into the tapered drive holes and are retained by the resilience of the U-shaped wire.

3 Claims, 1 Drawing Sheet

DRIVE CONNECTION FOR FUEL PUMP ROTOR

FIELD OF INVENTION

Fuel pumps for internal combustion engine in which an electric motor drives a pump rotor.

BACKGROUND AND OBJECTS OF THE INVENTION

In the drive of fuel pump rotors by the armature shaft of an electric motor, it has been common to utilize a flat on the shaft and in the rotor hole, or splines and grooves on the respective shaft and rotor, or axially projecting fingers which are extending from a hub driven by the armature and which extend into holes surrounding the center of the pump rotor.

It is an object of the present invention to provide a simple drive which does not reduce the surfaces of the drive shaft and which is achieved by a single U-shaped wire which has a bight in a slot in the drive shaft and legs extending into holes on each side of the shaft opening in the rotor. An advantage of the drive to be described lies in the ease of assembly and also in the fact that the armature shaft can be mounted for rotation in a bushing in a portion of the pump housing independent of the pump inlet housing to provide a centered, quiet operation. Reference is made to U.S. Pat. No. 4,445,820 issued May 1, 1984 wherein there is disclosed a U-drive element.

Other objects and features of the invention will be apparent in the following detailed description and claims in which there is set forth the invention together with details to enable a person to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
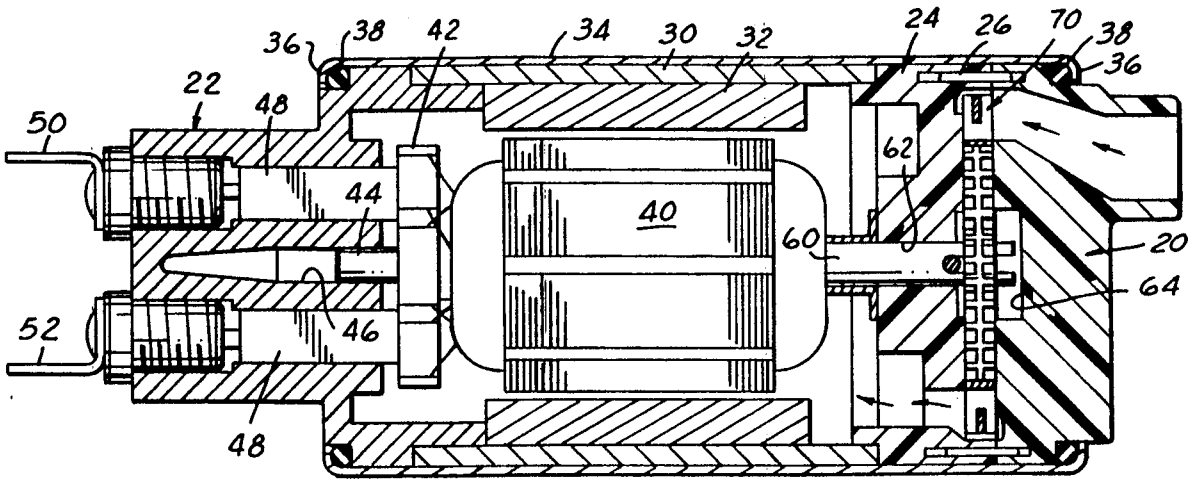
FIG. 1, a sectional view of a fuel pump.

With reference, first, to FIG. 1, a pump assembly is shown having an inlet housing 20, an outlet housing 22, an intermediate pump housing 24. Pins 26 keep housings 20 and 24 in registry. A cylindrical flux ring 30 is interposed between the inlet and outlet housings and this ring surrounds the permanent magnets 32. An encasement cover 34 encapsulates the inlet, outlet and intermediate housing 24 in a sealed relationship with inturned ends 36 over sealing rings 38.

Figure 5:
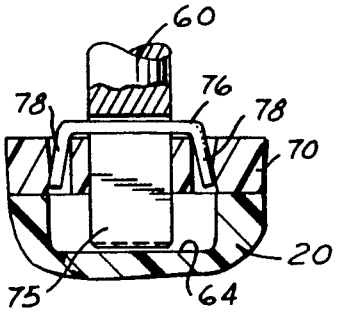
FIG. 5, a view showing the drive wire on the armature side of the pump rotor.
Figure 4:
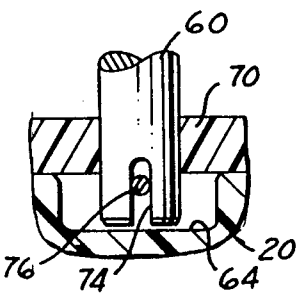
FIG. 4, a sectional view on line 4—4 of FIG. 3.
Figure 3:
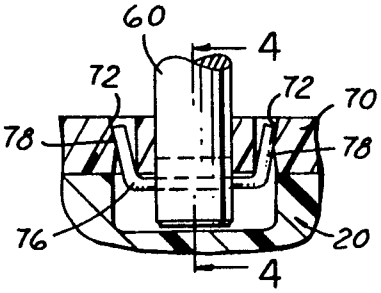
FIG. 3, a sectional view on line 3—3 of FIG. 2.
Figure 2:
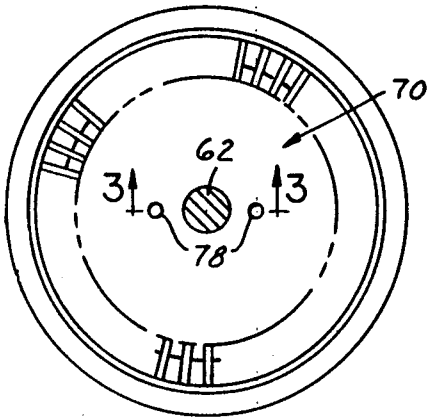
FIG. 2, an elevational view of a pump rotor.

An armature 40 has a commutator plate 42 at one end surrounding a bearing shaft 44 which is mounted in a bushing recess 46 in the outlet housing 22. Brushes 48 are suitably mounted in the outlet housing with connections 50 and 52. At the other end of the armature is a combined bearing and drive shaft 60 passing through a bushing hole 62 in the intermediate pump housing 24 and projecting into a central recess 64 in the inlet housing 20. This shaft 60 also projects through a pump rotor 70 of the regenerative type (See FIGS. 3 and 4). The pump rotor has spaced axial holes 72 on each side of the shaft hole with a double taper on the diametrically outer side. The end of the shaft 60 is slotted at 74 to receive the bight of a wide U-shaped drive wire 76 with legs 78 which, as shown in FIG. 3, project through the holes 72 to provide a drive between the shaft and the pump impeller 70. The legs 78 are preferably spread to a greater dimension at rest so they can be moved together in assembly to bear resiliently on the outside of the tapered holes 72. This will insure a tight connection. The slot 75 (FIG. 5) projects beyond the impeller so that the drive wire can be inserted from either side of the impeller. The double taper on the one side of holes 72 accommodates the retainer when the bight is positioned on the armature side of the rotor. This drive is simple and avoids flats or keys and thus provides a maximum amount of bearing surface between shaft and impeller.

It is also significant with this drive that there is no tendency to throw the impeller off-center as may happen with a multiple finger device which also puts a lateral force on the impeller. In addition to the low cost of the drive mechanism here described, because of the ease of slotting the shaft and placing holes in the impeller, the wire element can flex and absorb torsional shock. The shape of the holes and the angle on the legs of the wire element provides a device which is self-retaining.

It will be seen that extending shafts of the armature are mounted at one end in the outlet housing 22 and the other end in the pump housing 24. No flats or splines are needed. The split end of the shaft 60 carries the bight of the drive wire on either side of the rotor 70 as shown, respectively, in FIGS. 3 and 5.

What is claimed is:

1. In an electrically driven fuel pump, (a) a housing including an inlet body, an outlet body and a pump rotor body interposed adjacent said inlet body, (b) an armature between said outlet body and said pump rotor body having a first mounting shaft with a bearing mount in a recess in said outlet housing, and a second extended mounting shaft with a bearing mount on said pump rotor body, (c) a rotor recess in said pump rotor body, said second extended shaft projecting into said recess, (d) a rotor in said recess mounted on said extended shaft, said shaft being slotted to form an axial slot, (e) a U-shaped drive wire positioned with the bight in said shaft slot, and legs on said drive wire projecting into apertures in said rotor to effect a rotary drive from said shaft to said rotor, (f) said legs on said drive wire being angled away from said bight, and said apertures in said rotor being tapered away from said bight portion of said drive wire.

2. In an electrically driven fuel pump, (a) a housing including an inlet body, an outlet body and a pump rotor body interposed adjacent said inlet body, (b) an armature between said outlet body and said pump rotor body having a first mounting shaft with a bearing mount in a recess in said outlet housing, and a second extended mounting shaft with a bearing mount on said pump rotor body, (c) a rotor recess in said pump rotor body, said second extended shaft projecting into said recess, (d) a rotor in said recess mounted on said extended shaft, said shaft being slotted to form an axial slot, (e) a U-shaped drive wire positioned with the bight in said shaft slot, and legs on said drive wire projecting into apertures in said rotor to effect a rotary drive from said shaft to said rotor, (f) said axial slot in said extended shaft being dimensioned axially to extend through and beyond said rotor to the armature side of the rotor, and said bight of said drive wire being positioned in said slot on the armature side of the rotor.

3. In an electrically driven fuel pump, (a) a housing including an inlet body, an outlet body and a pump rotor body interposed adjacent said inlet body, (b) an armature between said outlet body and said pump rotor body having a first mounting shaft with a bearing mount in a recess in said outlet housing, and a second extended mounting shaft with a bearing mount on said pump rotor body, (c) a rotor recess in said pump rotor body, said second extended shaft projecting into said recess, (d) a rotor in said recess mounted on said extended shaft, said shaft being slotted to form an axial slot, (e) a U-shaped drive wire positioned with the bight in said shaft slot, and legs on said drive wire projecting into apertures in said rotor to effect a rotary drive from said shaft to said rotor, (f) said apertures in said rotor being tapered inwardly on the diametrically outer surface from each side of the rotor.

* * * * *